United States Patent [19]

Hashimoto

[11] Patent Number: 4,578,911

[45] Date of Patent: Apr. 1, 1986

[54] CANTILEVERED MAST DRILLING RIG WITH SINGLE STEP ERECTION

[75] Inventor: Tom T. Hashimoto, Conroe, Tex.

[73] Assignee: Branham Industries, Inc., Conroe, Tex.

[21] Appl. No.: 592,917

[22] Filed: Mar. 23, 1984

[51] Int. Cl.[4] ..... E04H 12/34

[52] U.S. Cl. ..... 52/120; 52/116

[58] Field of Search ..... 52/116–120

[56] References Cited

U.S. PATENT DOCUMENTS

| | | | |
|---|---|---|---|
| 3,271,915 | 9/1966 | Woolslayer et al. . | |
| 3,803,780 | 4/1974 | Donnally . | |
| 3,922,825 | 12/1975 | Eddy et al. | 52/125.2 X |
| 4,135,340 | 1/1979 | Cox et al. . | |
| 4,375,241 | 3/1983 | Gallon . | |
| 4,473,977 | 10/1984 | Reed | 52/116 |
| 4,478,015 | 10/1984 | Lawrence et al. | 52/116 X |
| 4,489,526 | 12/1984 | Cummins | 52/116 X |

FOREIGN PATENT DOCUMENTS

| | | | |
|---|---|---|---|
| 870386 | 3/1953 | Fed. Rep. of Germany | 52/116 |

OTHER PUBLICATIONS

Dresser Ideco HFM 142-1000.
Dreco, "Slingshot".
Olympic Iron Works Limited, "Swing Lift".
Branham Industries, Inc., "Swinglift".

*Primary Examiner*—Donald G. Kelly
*Assistant Examiner*—Richard E. Chilcot, Jr.
*Attorney, Agent, or Firm*—Arnold, White & Durkee

[57] ABSTRACT

A cantilevered mast drilling rig is disclosed in which the erection operation for elevating the cantilevered mast and the drill rig floor to the elevated operating positions is a single step procedure. Both the cantilevered mast and the drill rig floor are completed on the ground prior to the elevating operation. The drill rig floor is pinned to the cantilevered mast so that, in response to actuation of the drawworks, the mast and drill rig floor are elevated to their operating positions as a single unit in a single operation.

9 Claims, 4 Drawing Figures

CANTILEVERED MAST DRILLING RIG WITH SINGLE STEP ERECTION

BACKGROUND OF THE INVENTION

The present invention relates to cantilevered mast drilling rigs. More particularly, the present invention relates to a method and apparatus for erecting the mast and drill rig floor to their elevated operating positions over the well in a single operation.

Cantilevered mast drilling rigs are extensively used in land based drilling operations. Various approaches have been practiced by the prior art in constructing, assemblying, and erecting these cantilevered mast drilling rigs over a well site. In its operating configuration, the drilling rig is characterized by a substructure support arrangement which rests on the ground. This sub-base structure supports both the mast in its vertical operating position and the drill rig floor, which is also elevated some distance above the ground. Various items of equipment, such as an "Iron Roughneck", a rotary table, a drawworks, etc., are typically used during drilling operations on the drill rig floor in the elevated position.

In the prior art, the erection of a cantilevered mast drilling rig involved the operations of first elevating the cantilevered mast from a horizontal position at the ground level to a vertical position over the well. Secondly, a drill rig floor was then elevated from a horizontal position at the ground to the desired operating height with the rotary table positioned over the centerline of the well. In all known instances, the erection of a cantilevered mast drilling rig to its elevated operating position has involved at least a two-step operation.

Preliminary to the erection operation, the various sections of the mast, the substructure support apparatus, and the drill rig floor components are all assembled on the ground above the well site. The "fastline" from the drawworks is then reeved over the fastline sheave at the top of the mast, through the traveling block (to become the "drill lines"), and fastened to at a deadline anchor. The erection of the drilling rig then proceeds with the two-step operation.

In the first step, the cantilevered mast is rotated from its horizontal position at the ground level to its vertical operating position. The erection force is typically provided by operation of the drawworks. In most instances, the mast is pinned to a portion or what eventually will be the drill rig floor. In the second operation, the drilling rig floor with the elevated mast is then raised to the horizontal operating position above the well. The cantilevered drilling rig manufactured by Dreco incorporates a pair of A-leg assemblies at one end of the substructure support. Over these A-leg assemblies pass a series of cables. These cables provide the lifting force for raising the elevated mast and rig floor to the final elevated operating position.

The cantilevered mast drilling rig manufactured by Olympic Ironworks, Ltd., is raised in a similar two-step operation. First, the conventional mast is raised by operation of the drawworks prior to elevating of the drill floor. The entire drill floor assembly with upright mast is then raised to the operating position using substructure mounted cylinders or winches. Four support legs for the drill rig are powered during the raising operation. These legs are pinned to both the substructure support apparatus as well as the floor so that as the floor and elevated mast are raised, the floor remains horizontal at all times. U.S. Pat. Nos. 3,271,915; 3,803,780; and 4,375,241 are further example of cantilevered mast drilling rigs which are erected in two-step operations. For example, U.S. Pat. No. 3,803,780 illustrates a first step operation in which the mast is elevated by actuation of the drawworks which is positioned on the ground on top of the sub-base support structure. The second step operation utilizes the power of the drawworks to raise the drill floor containing the drawworks up to the elevated operating position. U.S. Pat. No. 4,375,241 discloses an erection technique whereby the mast is first elevated to the vertical position by the drawworks followed by a second operation in which the floorand elevated mast are raised vertically straight up to the elevated operating position. Hydraulic piston arrangements are provided for elevating the floor and mast in the second step of the erection operation.

The cantilevered mast drilling rig manufactured by Branham Industries, Inc., the "Swing Lift", likewise is erected in a two-step operation. The mast is first pinned to the substructure support. The drill floor for the Swing Lift rig is divided into two halves. On a first half, the "drawworks floor", is mounted the drawworks. The drawworks is used in the first erection step to raise the mast and the second half of the drill floor, the "setback floor", to the vertical operating position. The "sling line" from the drawworks used to erect the mast is then re-reeved onto additional sheaves on the drawworks floor, and the drawworks then used to raise that half of the drill floor up to the operating position. The cantilevered mast of the Swing Lift rig is pinned to and supported by the sub-base support structure at all times. However, enough structural height is provided to permit the drilling rig floor to be elevated to its proper height.

These two-step erection operations for erecting prior-art cantilevered mast drilling rigs have several disadvantages. First, the operation of elevating the portion of the drill rig floor containing the drawworks up to the desired elevated position requires that an operator ride the floor up to the operating position. This is dangerous, and in all cases, the two-step operation is slow and costly. In many instances, the tools needed for the drilling operations must wait until the floor has been lifted to the elevated operating position before they may be installed. This adds to the danger of the erection operation, as well as, requiring the use of expensive large cranes to lift the tools from the ground to the drill floor.

SUMMARY OF THE INVENTION

In accordance with the present invention there is disclosed a cantilevered mast drilling rig which solves the disadvantages of the prior art. The erection process according to the present invention is a single step operation. The present invention comprises a drilling rig having a drilling floor with a drawworks-side portion and a setback-side portion, a rotatable cantilevered mast, and a power driven lifting means connected to the mast. The floor and mast are each connected to a substructure support. The floor is further pinned to the mast so that the floor and the mast are raised in a single operation to their elevated operating positions as the mast is raised by the lifting means. The rig further includes a pair of mast support members mounted on the substructure support for supporting the mast in its elevated vertical operating position.

The lifting means is connected to the mast and the mast support means, and responds to operation of the drawworks to lift the mast and the completed floor to their elevated operating positions. The lifting means comprises a fixed length sling line which is pinned at each end to the mast at points proximal to the mid-point of the mast. A sling line equalizing sheave is connected to the traveling block of the rig and receives a portion of the sling line which passes around the equalizing sheave. Further additional fixed sheaves, some mounted on the cantilevered mast and others on the mast support members are provided for receiving portions of the sling line. The reeving of the sling line is such that actuation of the drawworks to lift the traveling block imparts a lifting force to the mast at the points where the ends of the sling line are connected to the mast. Movement of the traveling block towards the top of the mast raises the mast from its horizontal position on the ground to its vertical operating position.

Included with the mast support members is a set of snubbing units to absorb the force of the cantilevered mast as it comes to rest in its vertical position on the mast support members. The mast support members are pinned to the substructure support so that the support members may be raised from a first collapsed position to a second up-right operating position for receiving and supporting the vertical mast. Placing the mast support members in their first collapsed positions facilitates transportation of the substructure support.

In another aspect of the invention, a method of erecting a cantilevered mast drilling rig is disclosed. In a first step, a complete drilling rig floor, including the tools and equipment to be used in the drilling operations, is connected to a substructure support. A cantilevered mast is then pinned to the substructure support to permit the mast to be raised from a first horizontal position at the ground level to a second elevated vertical operating position. The cable of a drill rig drawworks mounted to the substructure support is reeved with the traveling block in the mast. A sling line lifting assembly is then connected to the traveling block. The completed floor is then pinned to the mast and the drawworks operated to lift the traveling block thereby raising the mast and the floor in a single operation from the ground level to their elevated operating positions with the tools and equipment to be used in the drilling operation already in position and ready for operation.

BRIEF DESCRIPTION OF THE DRAWING

For a fuller understanding of the invention, reference should be had to the following drawings in which.

Similar reference numerals refer to similar parts throughout the various views of the drawings.

DETAILED DESCRIPTION OF THE PREFERRED EMBODIMENT OF THE INVENTION

Figure 1:
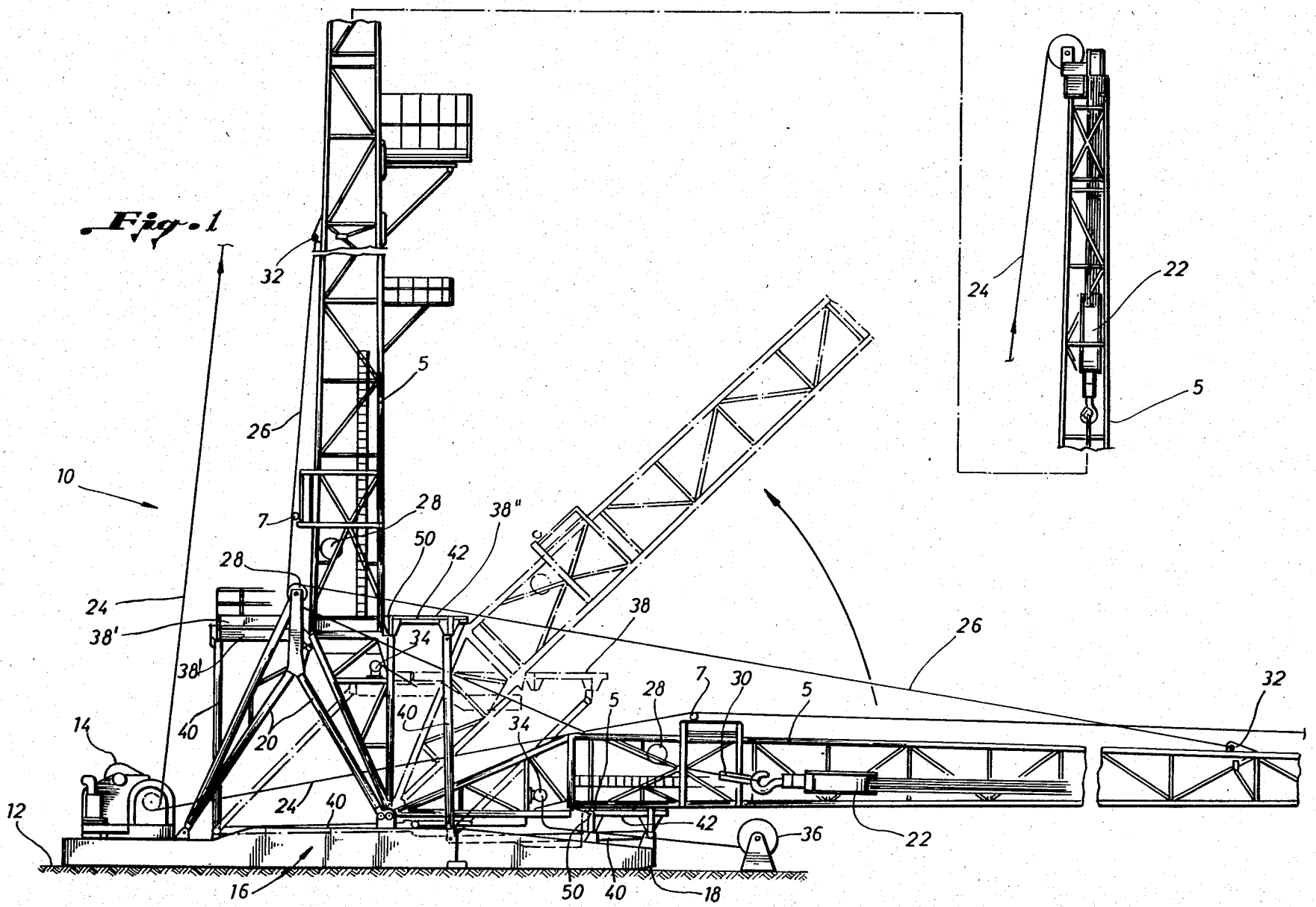
FIG. 1 is an illustration of the drilling rig of the present invention showing the cantilevered mast in three positions during the erection operation.

Turning now to the figures, and first to FIG. 1, there is illustrated the cantilevered mast drilliing rig 10 according to the present invention. The cantilevered mast 5 and completed drilling rig floor 38 are illustrated in three positions during the erection process, the horizontal position at which the various pieces of the mast 5 and drill floor 38 are assembled together, to a position in which the mast 5 is halfway to its vertical operating position, and finally, with the mast 5 and drill floor 38 in their elevated operating positions above the centerline of the well.

Figure 2:
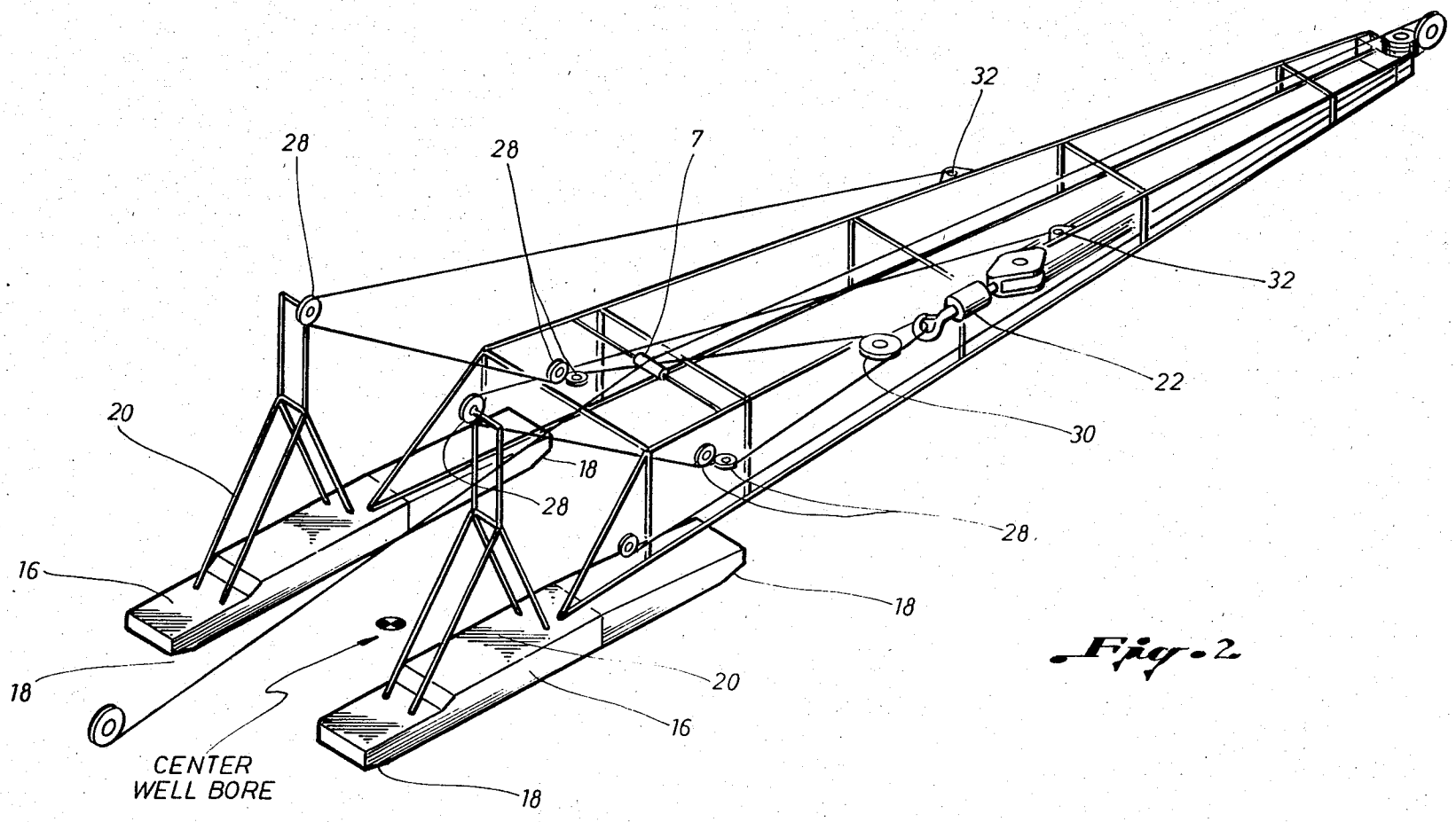
FIG. 2 is a reeving diagram of the fast line and sling line cables according to the present invention.

In accordance with the present invention, the drawworks 14, which is used in the drilling operations to raise and lower the drill pipe, among other things, is shown permanently installed to one end of the substructure support members 16. In addition to the drilling operations, the drawworks 14 is also used in the erection process to raise the mast 5 and the drill floor 38 to the elevated operating position. Prior to the erection operation, the entire drilling rig 10 must first be assembled from its various pieces. The substructure 16 is first placed over the well in a position so that when the mast is raised, the traveling block 22 and rotary table (not shown) will be directly over the centerline of the well. The substructure assembly 16 consists of two sub-base boxes or supports (see FIG. 2). Each box 16 is provided with tapered sled ends 18 to facilitate movement of drilling rig 10 along the ground, such as to another well site.

After the substructure support members 16 are positioned at the proper place, the assembly process for the remaining portions of the rig can now begin. The particular sequence of assembly of the pieces does not necessarily have to follow any particular order, but, for purposes of discussion, the first step in the assembly process could be the mounting of the drawworks 14 to the substructure boxes 16. The drawworks 14 will remain at the ground level connected to one end of the substructure support 16 at all times.

In FIG. 1 there is illustrated an A-frame mast support member 20 which is pinned to the substructure support 16 at two positions, 37 and 39. A similar mast support member 20 is provided on the opposite side of the rig 10 shown in FIG. 1. A more complete detail of the operations of the A-frame mast support members 20 is shown in FIGS. 3 and 4.

Figure 3:
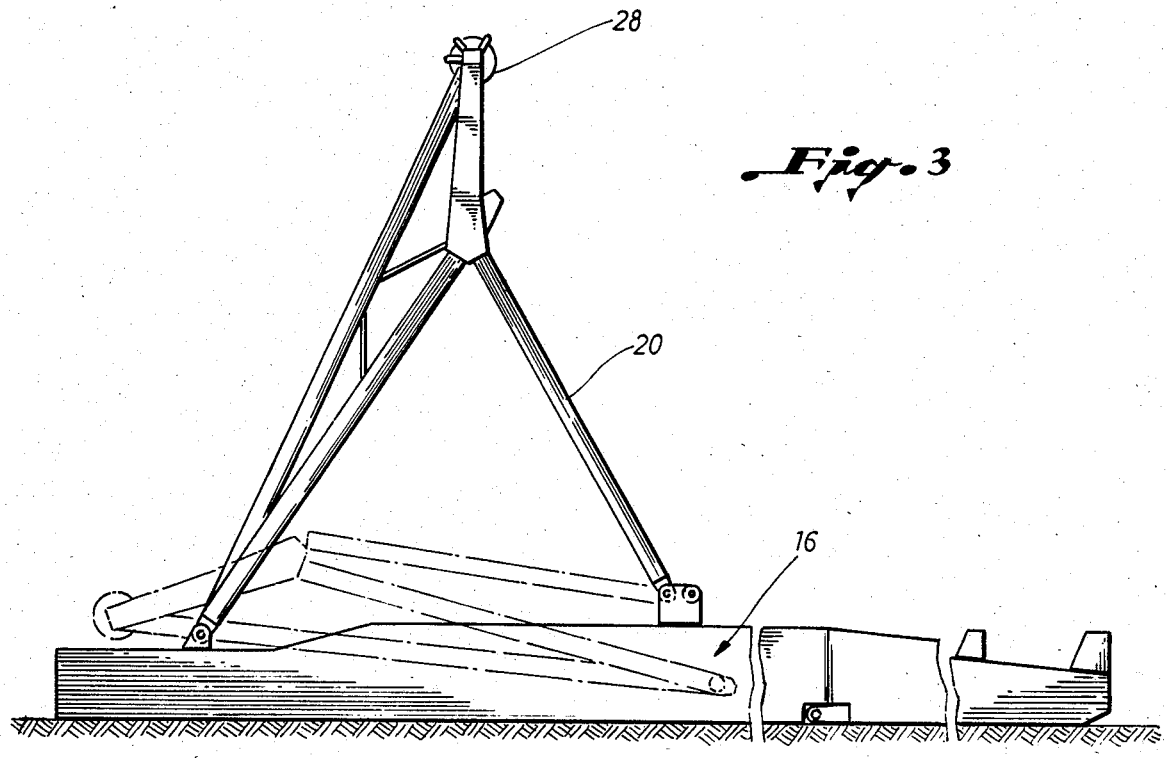
FIG. 3 is an illustration of one of the A-frame mast supports members which support the mast in its vertical operating position.
Figure 4:
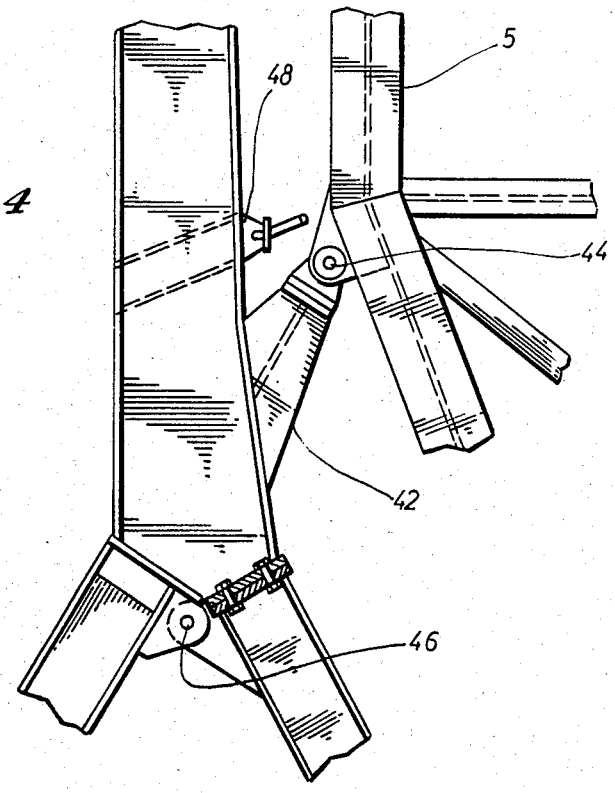
FIG. 4 is a detailed drawing of a portion of the A-frame mast support member shown in FIG. 3.
Figure 1:
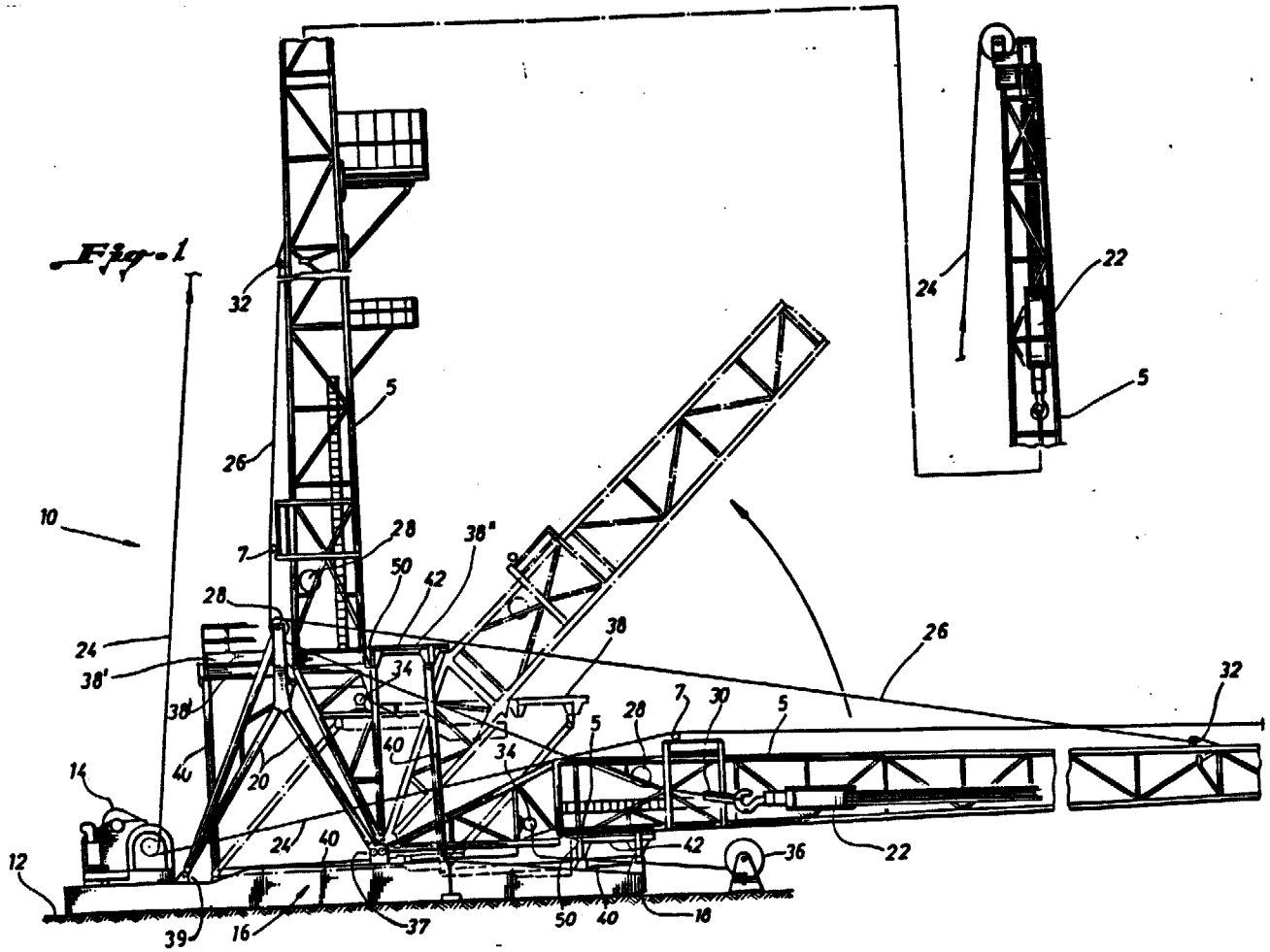

FIG. 3 illustrates how the A-frame mast support members 20 may be unpinned from its respective substructure support member 16 and rotated to a collapsed position. This collapsed position facilitates shipment of the substructure supports. As shown in FIG. 4, the A-frame mast support member 20 is pinned at the apex of the A-frame legs to permit the support member to fold in on itself and assume the position illustrated in FIG. 3. Further, FIG. 4 illustrates that when the mast 5 is in its vertical position, the mast is pinned to a support element 42 of the A-frame mast support element 20 by pin 44. Once the cantilevered mast 5 is in its vertical position and resting on the support member 20, the mast can then be securely pinned to the substructure support via the mast support members 20.

Referring again to FIG. 1, the drill floor 38 may now be assembled and attached to the substructure support 16. The entire drill floor 38 having a drawworks-side portion 38' and a setback-side portion 38" is coupled to the substructure support elements 16 by four rotatable leg segments 40, one at each corner of the drill floor. The rotatable leg support elements 40 are pinned at opposite ends, respectively, to the drill floor and to one of the substructure support members 16. The lengths of the support legs 40 are such that the floor remains parallel to the ground at all times as the drill floor 38 is raised to the elevated operating position.

Once the entire drill floor is assembled and connected to the substructure element 16, installation of the equipment to be used in the drilling operations for this well may begin. This permits the equipment, such as the "Iron Roughneck", rotary table, catworks, tools, etc., to be mounted to the drill floor while the drill floor is now on the ground. This eliminates any need for the lifting of heavy equipment up to the drill floor once the mast and floor have been erected to the elevated operating position.

Once the floor 38 has been assembled, the A-frame support members 20 are rotated from their collapsed position to their upright position (see FIG. 3) and pinned at point 39. The mast 5 may now be assembled from the various sections such as the bottom, lower, mid, upper, and top sections. When assembled, the mast 5 will be in a horizontal position at the ground level. The mast 5 is provided with sufficient length at the lower section so that when the mast is raised to the elevated position there is sufficient clearance from the rig floor to the ground level to clear such equipment as the well blowout preventers.

Still referring to FIG. 1, in addition to pinning the drill floor 38 to the substructure support 16 via the support legs 40, the floor 38 is also pinned to the mast 5 at points 50. By pinning the drill floor 38 to the mast 5 in accordance with the present invention, as the drill mast 5 is erected by actuation of the drawworks 14, the drill floor 38 will be elevated to its operating position in the same operation.

As previously mentioned, the operation of elevating the mast 5 and drill floor 38 from the horizontal position at the ground level is under control of the drill rig drawworks 14. In accordance with the present invention, the drawworks will remain at ground level connected to one end of the substructure support elements 16. From this position, the drawworks 14 is used in the elevation of the mast 5 as well as the drilling operations.

As shown in FIG. 1, a fast line 24 from the drawworks 14 passes over the fast line breakover roller 7 and continues to the top of the mast (crown block) where it passes over a sheave into the mast 5. From there it is reeved into the traveling block 22 with its hook and becomes the "drill lines" of the rig. The reeving of the cable occurs between the crown block at the top of the drill mast to the traveling block 22, and eventually fastened to the deadline anchor 34. From the deadline anchor 34 the cable is passed out to a wireline spool 36 where it is finally terminated. Operation of the drawworks 14 in this configuration permits movement of the traveling block 22 along the length of the mast 5. Of course, when the mast 5 is in the horizontal position this movement of the traveling block 22 is in a horizontal plane, whereas, in the elevated vertical position, the movement is up and down.

As noted above when the mast 5 is in the horizontal position the drawworks 14 will be used to elevate the mast from the horizontal to the vertical position. To facilitate this operation, a fixed-length sling line 26 is provided to convert the force transmitted to the traveling block by operation of the drawworks to a lifting force which rotates the mast from the horizontal to the vertical position. As shown in FIG. 1, one end of the sling line 26 is shown connected to the mast 5 at a pinned position 32 which is proximal the mid-point of the mast 5. Each end of the sling line 26 is connected to the mast 5 at the pin location 32, one on both sides of the mast. The sling line 26 then passes around a sheave located at the top of each of the A-frame mast support members 20. The sling line 26 is then redirected back into the interior of the mast 5. There, the line passes over a plurality of direction control sheaves 28 mounted internal to the mast. Finally, the sling line 26 passes around the sling line equalizing sheave 30.

The sling line equalizing sheave 30 is connected to the hook of the traveling block 22, and functions to equalize the force in each side of the sling line 26 passing around the equalizing sheave. In this way, as the drawworks 14 is activated to move the traveling block 22 towards the top of the mast 5, the force imparted to the sling line 26 through the equalizing sheave 30 exerts a lifting force at the pinned ends of the sling line 26 at points 32 on the mast 5. As shown in FIG. 1, movement of the traveling block 22 to the top of the mast 5 raises the mast from the horizontal position to the vertical position. As previously noted, the completed rig floor is pinned to the mast at point 50 to permit rotation and lifting of the floor as the mast is raised by the drawworks 14 to the vertical position.

Turning once again to FIG. 4, there is shown the mast 5 pinned at point 44 to one of the A-frame mast support members 20. The mast 5 is designed so that the center of gravity of the mast passess over the vertical before the mast actually reaches the final vertical position. In this way, the mast 5, in its pinned position on the A-frame support members 20, will actually be resting on the supports 20, i.e., the mast will not be in an unstable position when in its operating position. Because there will be the weight of the mast 5 on the A-frame support elements 20 when fully erected, during the erection operation, the mast will tend to strike the A-frame elements 20 as it nears its vertical position. In order to counteract these forces, hydraulically operated snubbing units 48 are provided on the A-frame mast support elements 20 to absorp the forces of the mast as it comes to rest on the support members 20.

In accordance with the present invention, the mast and complete drill rig floor are raised to the elevated operating positions in a single operation as a result of the actuation of the drawworks 14. Additionally, the drawworks remain on the ground both during the erection operation, as well as the final drilling operations. Several significant advantages result from this arrangement. First, with the drawworks 14 on the ground it is possible for people to utilize older types of powered drawworks such as those driven by diesel engines, to be used for the drawworks 14. Second, it is much safer to have the drawworks 14 on the ground at all times. Having the drawworks on the ground during drilling operations eliminates the danger of people getting pinched or drawn into the drawbacks since the operators will be up on the drill rig floor 38 away from the drawworks 14.

With the drawworks 14 remaining on the ground, the danger of having someone "riding" the drill rig floor during the erection operation is also eliminated. Third, with the entire drill rig floor on the ground before erection, it is now possible to install all of the very heavy equipment needed in the drilling operations at the ground level before erection of the drill rig floor. Readily available gin pole trucks can be used for these operations rather than having to provide large, expensive cranes at the well site to lift these tools to the drill rig floor after it is erected. The cantilevered drilling rig of the present invention is safer, easier to erect, and less expensive than rigs of the prior art. Additionally, with the drawworks 14 left on the substructure support, there is approximately 40% more working area on the drill floor 38 available for other equipment during drilling operations. Because the present invention permits the erection operation to occur in a single operation, the lowering operation is also in a single operation which is much faster than in the prior art. This speed is an advantage when weather conditions, such as a hurricane, necessitate a lowering of the rig.

In describing the invention, reference has been made to its preferred embodiment. However, those skilled in the art and familiar with the disclosure of the invention may recognize additions, deletions, substitutions, or other modifications which would fall within the purview of the invention as defined in the appended claims. For example, while the present invention illustrates the drawworks 14 mounted to the substructure support element 16 at all times, it is possible that the drawworks could be mounted to the complete drill rig floor 38 prior to the erection operation, and some other lifting means provided to actuate the operations of the sling line 26, or have the drawworks on the drill floor power the raise operation.

What is claimed is:

1. A cantilevered mast drilling rig suitable for land operations comprising:

(a) a sub-base box structure positioned on the ground for supporting the drilling rig;

(b) a cantilevered mast pinned to said sub-base box structure and rotatable from a first horizontal position to a second vertical position;

(c) mast support members mounted to said sub-base box structure for supporting said mast in its vertical position;

(d) a drawworks mounted to one end of said sub-base box structure for raising said mast and for use in operating said drilling rig;

(e) a lifting means connected to said mast and said mast support members and responsive to said drawworks for lifting said mast to its vertical position; and (f) a completed drill rig floor having a drawworks-side portion and a setback-side portion, said floor coupled to said mast and having a plurality of rotatable leg members, each pinned to said floor and to said sub-base box structure, said floor and said mast, responsive to said drawworks, moving in a single operation from a first horizontal position at the ground level to a second raised operating position as said mast is raised to its vertical position.

2. The rig of claim 1 further including substructure girders having skid ends to permit skidding of said sub-base box structure along the ground.

3. The rig of claim 1 further including snubbing units mounted to said mast support members for absorbing the forces of the cantilevered mast as it comes to rest on said mast support members in its vertical position, each said support member being rotatable from a first collapsed position to a second up-right operating position, where the collapsed position facilitates transportation of said sub-box support.

4. The rig of claim 1 further including a traveling block responsive to said drawworks, said lifting means comprising:

(a) a fixed length sling line pinned at each end to said mast at points proximal the mid-point of said mast;

(b) a sling line equalizing sheave connected to said traveling block; and (c) a plurality of fixed sheaves mounted to said cantilevered mast and said mast support members, said sling line passing over, or by each of said sheaves so that when said traveling block is moved towards the top of said mast in response to actuation of said drawworks, said sling line rotates said mast and said floor to their elevated operating positions.

5. A drilling rig suitable for land operations having a cantilevered mast rotatable from a first horizontal position at ground level to a second elevated vertical operating position, a drawworks connected by a fastline to a traveling block in said mast, and a completed drill rig floor having a drawworks-side portion and a setback-side portion, said floor rotatable from a first horizontal position at ground level to a second elevated horizontal operating position, each connected to a substructure support, said floor pinned to said mast such that actuation of said drawworks to reel in said fastline raises in a single operation said mast and said floor to their elevated operating positions.

6. The rig of claim 5 further including (a) a pair of mast support members mounted to said substructure support for supporting said mast in its elevated vertical operating position; and (b) a lifting means connected to said mast and said mast support members and responsive to said drawworks for lifting said mast and said completed floor to their elevated operating position, said means comprising, (i) a fixed length sling line pinned at each end to said mast at points proximal the mid-point of said mast;

(ii) a sling line equalizing sheave connected to said traveling block; and (iii) a plurality of fixed sheaves mounted to said cantilevered mast and said mast support members, said sling line passing over, or by each of said sheaves so that when said traveling block is moved towards the top of said mast in response to actuation of said drawworks, said sling line rotates said mast and said floor to their elevated operating positions.

7. The rig of claim 6 further including a snubbing unit mounted on each said mast support member to absorb the shock forces of said mast as it comes to rest on said support member.

8. A drilling rig having a drilling floor with a drawworks-side portion and a setback-side portion, a rotatable cantilevered mast, and a power driven lifting means connected to said mast, said floor and mast connected to a substructure support, said floor further connected to said mast so that said floor and said mast are raised in a single operation to their elevated operating position as said mast is rotated to a vertical position by said lifting means.

9. A method of erecting a cantilevered mast drilling rig comprising the steps of:

(a) connecting to a substructure support at ground level a completed drill rig floor having a drawworks-side portion and a setback-side portion (including the tools and equipment to be used in the drilling operations);

(b) pinning the cantilevered mast to the substructure support to permit said mast to rotate from a first horizontal position at ground level to a second elevated vertical operating position;

(c) cabling a drill rig drawworks mounted to said substructure support to a traveling block in said mast;

(d) connecting a sling line pinned at both ends to said mast to said traveling block;

(e) pinning said completed floor to said mast; and (f) operating said drawworks to lift said traveling block thereby raising said mast and said floor in a single operation from the ground position to their elevated operating positions.

* * * * *

UNITED STATES PATENT AND TRADEMARK OFFICE

CERTIFICATE OF CORRECTION

PATENT NO. : 4,578,911

DATED : April 1, 1986

INVENTOR(S) : Tom T. Hashimoto

It is certified that error appears in the above—identified patent and that said Letters Patent is hereby corrected as shown below:

In the attached drawing, in FIG. 1, pins 37 and 39 are marked.

Column 2, line 12, change "floorand" to --floor and--.

Column 6, line 55, change "drawbacks" to --drawworks--.

Figure 1 should be shown as per attached sheet.

Signed and Sealed this

Fourth Day of November, 1986

[SEAL]

*Attest:*

*Attesting Officer*

DONALD J. QUIGG

*Commissioner of Patents and Trademarks*